US007448135B2

(12) United States Patent
Zhuk et al.

(10) Patent No.: US 7,448,135 B2
(45) Date of Patent: Nov. 11, 2008

(54) MULTI-BLADE RAZORS

(75) Inventors: Andrew Zhuk, Acton, MA (US); Weili Yu, Medfield, MA (US); Hoang Mai Trankiem, Boston, MA (US); Neville Sonnenberg, Newton, MA (US); Kevin L. Powell, Hants (GB); Yiqian Eric Liu, Lexington, MA (US); Robert L. Lescanec, Boston, MA (US); Steve S. Hahn, Wellesley, MA (US); Joseph A. DePuydt, Quincy, MA (US); Alan Crook, Tadley Hants (GB); Cinzia Simonis Cloke, Arlington, MA (US)

(73) Assignee: The Gillette Company, Boston, MA (US)

( * ) Notice: Subject to any disclaimer, the term of this patent is extended or adjusted under 35 U.S.C. 154(b) by 144 days.

(21) Appl. No.: 11/392,148

(22) Filed: Mar. 29, 2006

(65) Prior Publication Data

US 2007/0227010 A1 Oct. 4, 2007

(51) Int. Cl.
*B26B 21/22* (2006.01)

(52) U.S. Cl. ..... 30/50; 30/77

(58) Field of Classification Search ..... 30/34.05, 30/34.2, 43.1, 50, 77
See application file for complete search history.

(56) References Cited

U.S. PATENT DOCUMENTS

| | | | |
|---|---|---|---|
| 1,579,844 | A | 4/1926 | Smith |
| 3,754,329 | A | 8/1973 | Lane |
| 3,777,396 | A | 12/1973 | Simonette |
| 3,834,017 | A | 9/1974 | Tolmie |
| 3,834,947 | A | 9/1974 | Swoboda et al. |
| 3,871,073 | A | 3/1975 | Nissen et al. |
| 3,911,579 | A | 10/1975 | Lane et al. |
| 3,949,470 | A | 4/1976 | Hall |
| 4,044,463 | A | 8/1977 | Tietjens |
| 4,167,662 | A | 9/1979 | Steen |

(Continued)

FOREIGN PATENT DOCUMENTS

| | | | |
|---|---|---|---|
| DE | 853397 | A | 7/1949 |

(Continued)

OTHER PUBLICATIONS

Report No. 3709/10024, O. D. Oglesby, 'Extending Hairs With Controlled Forces', 15 Pages, 8 Figures, 1 Table, 6 Plates, date unknown.

(Continued)

*Primary Examiner*—Timothy V Eley
(74) *Attorney, Agent, or Firm*—Dara M. Kendall; Kevin C. Johnson; Steven W. Miller

(57) ABSTRACT

Multi-blade razors are provided, having blades with differing properties. In one aspect, a razor is provided that includes a safety razor blade unit comprising a guard, a cap, and first, second and third blades with parallel sharpened edges located between the guard and cap with the first blade closest to the cap, the third blade furthest from the cap, and the second blade disposed between the first and third blades, the blades having first, second and third tip radii, respectively, at least two of the three blades having different tip radii, and at least two of the blades having different coefficients of friction.

7 Claims, 1 Drawing Sheet

U.S. PATENT DOCUMENTS

| | | | | |
|---|---|---|---|---|
| 4,304,978 | A | 12/1981 | Saunders | |
| 4,473,735 | A | 9/1984 | Steffen | |
| 4,507,538 | A | 3/1985 | Brown et al. | |
| 4,980,021 | A | 12/1990 | Kitamura et al. | |
| 4,998,347 | A | 3/1991 | Schachter | |
| 5,347,887 | A | 9/1994 | Rosenthal et al. | |
| 5,360,495 | A | 11/1994 | Schuler et al. | |
| 5,426,851 | A * | 6/1995 | Gilder et al. | 30/50 |
| 5,488,774 | A | 2/1996 | Janowski | |
| 5,522,137 | A | 6/1996 | Andrews | |
| 5,532,495 | A | 7/1996 | Bloomquist et al. | |
| 5,546,660 | A | 8/1996 | Burout et al. | |
| 5,575,185 | A | 11/1996 | Cox et al. | |
| 5,630,275 | A * | 5/1997 | Wexler | 30/50 |
| 5,906,053 | A | 5/1999 | Turner et al. | |
| 6,055,731 | A | 5/2000 | Zucker | |
| 6,077,572 | A | 6/2000 | Hopwood et al. | |
| 6,082,007 | A | 7/2000 | Andrews | |
| 6,156,435 | A | 12/2000 | Gleason et al. | |
| 6,161,287 | A * | 12/2000 | Swanson et al. | 30/50 |
| 6,161,288 | A * | 12/2000 | Andrews | 30/50 |
| 6,178,852 | B1 | 1/2001 | Pfaff | |
| 6,212,777 | B1 * | 4/2001 | Gilder et al. | 30/50 |
| 6,216,349 | B1 * | 4/2001 | Gilder et al. | 30/346.57 |
| 6,243,951 | B1 * | 6/2001 | Oldroyd | 30/34.2 |
| 6,289,593 | B1 * | 9/2001 | Decker et al. | 30/346.54 |
| 6,295,734 | B1 * | 10/2001 | Gilder et al. | 30/50 |
| 6,335,506 | B2 | 1/2002 | Christmas et al. | |
| 6,353,204 | B1 | 3/2002 | Spaay et al. | |
| 6,442,840 | B2 * | 9/2002 | Zucker | 30/42 |
| 6,468,642 | B1 | 10/2002 | Bray et al. | |
| 6,511,559 | B2 | 1/2003 | Brenner et al. | |
| 6,534,131 | B1 | 3/2003 | Domoto et al. | |
| 6,612,204 | B1 | 9/2003 | Droese et al. | |
| 2001/0013174 | A1 | 8/2001 | Zucker | |
| 2001/0015348 | A1 | 8/2001 | Christmas et al. | |
| 2002/0066186 | A1 | 6/2002 | White et al. | |
| 2002/0100522 | A1 | 8/2002 | Benton et al. | |
| 2003/0094077 | A1 | 5/2003 | Hoffman | |

FOREIGN PATENT DOCUMENTS

| | | | |
|---|---|---|---|
| EP | 0 191 203 | A2 | 8/1986 |
| EP | 0 640 693 | A1 | 3/1995 |
| EP | 0 850126 | B1 | 1/2001 |
| JP | 60165319 | | 8/1985 |
| JP | 60258416 | | 12/1985 |
| JP | 04263020 | | 9/1992 |
| WO | WO 94/26476 | A | 11/1994 |
| WO | WO 97/10083 | A2 | 3/1997 |
| WO | WO 97/10083 | A3 | 3/1997 |
| WO | WO 2004/112986 | A1 | 12/2004 |

OTHER PUBLICATIONS

Report No. 3677/10024, O. D. Oglesby, 'Beard Hair Response To Applied Forces', 27 Pages, 11 Figures, 3 Tables, 3 Plates, dated Apr. 12, 1995.

PCT International Search Report dated Aug. 21, 2007.

* cited by examiner

MULTI-BLADE RAZORS

TECHNICAL FIELD

This invention relates to multi-blade razors and blades for use in multi-blade razors.

BACKGROUND

In shaving, it is desirable to achieve a close shave, while also providing good shaving comfort and avoiding nicks and cuts. Factors that affect shaving performance include the frictional resistance between the blade edge(s) and the skin and sharpness of the blade edge(s), both of which effect the cutter force applied by the blade(s) to the hair. Another factor that affects shaving performance and blade wear is the blade exposure, i.e., the extent to which the blade tip extends beyond a plane defined, as will be discussed below, between two adjacent skin contact points of the razor. Blades can be positioned with a neutral exposure (the blade tip in the plane), a positive exposure (the blade tip extending beyond the plane), or a negative exposure (the blade tip is recessed behind the plane). Negative exposures are possible because skin is deformable and thus "flows" into the area behind the plane. More positive exposures will tend to give a closer shave, but may also present more danger of nicks and cuts. In many multi-blade razors the different blades are positioned at different exposures. As a result, the blades contact the skin differently and tend to wear at different rates.

SUMMARY

The invention features multi-blade razors in which at least some of the different blades have different tip radii, and thus have different relative sharpness. At least some of the blades also have different coefficients of friction. The tip radii and coefficients of friction of the different blades can be selected to provide the razor with desired performance characteristics. In some implementations, the blades are positioned at different exposures, in which case the tip radius and coefficient of friction of each blade may be selected based on the relative exposure of the blade.

In general, the invention features razors that include a safety razor blade unit comprising a guard, a cap, and first, second and third blades with parallel sharpened edges located between the guard and cap.

In one aspect, the invention features a razor in which the first blade is closest to the cap, the third blade is furthest from the cap, and the second blade is disposed between the first and third blades. The blades have first, second and third tip radii, respectively, with at least two of the three blades having different tip radii, and at least two of the blades having different coefficients of friction.

Some implementations may include one or more of the following features. The first blade has a higher coefficient of friction than the second blade. The first blade has a smaller tip radius than the second blade. The third blade has a smaller tip radius than the second blade. The first blade has a higher coefficient of friction than the third blade. The first blade has a lower coefficient of friction than the second blade. At least two of the blades include polymer coatings having different relative thicknesses.

The invention also features, in other aspects, blade units having the characteristics described herein, and methods of shaving with the razors described herein.

Tip radius may be measured by estimating the radius of the largest circle that may be positioned within the ultimate tip of the edge when the ultimate tip is viewed under a scanning electron microscope at magnifications of 50,000×. The blade is edge tilted at 30 degrees from the incoming electron beam source in the plane of the blade.

Coefficient of friction may be derived indirectly by measuring the cutter force of different blades having the same tip geometry under the same conditions, varying only the surface characteristics of the blade. To determine whether two blades having different tip radii have the same or different coefficients of friction, one of the blades would be replicated in all other respects except for tip radius, to have the same tip radius as the other blade, and then the cutter forces of the blades (the two blades with the same tip radius) would be tested and compared. If the cutter forces are the same, the blades are deemed to have the same coefficient of friction; if one blade has a higher cutter force, that blade is deemed to have a higher coefficient of friction than the other blade.

Preferred razors exhibit a good balance of shaving closeness and comfort, with minimal nicks and cuts even for users susceptible to nicking.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
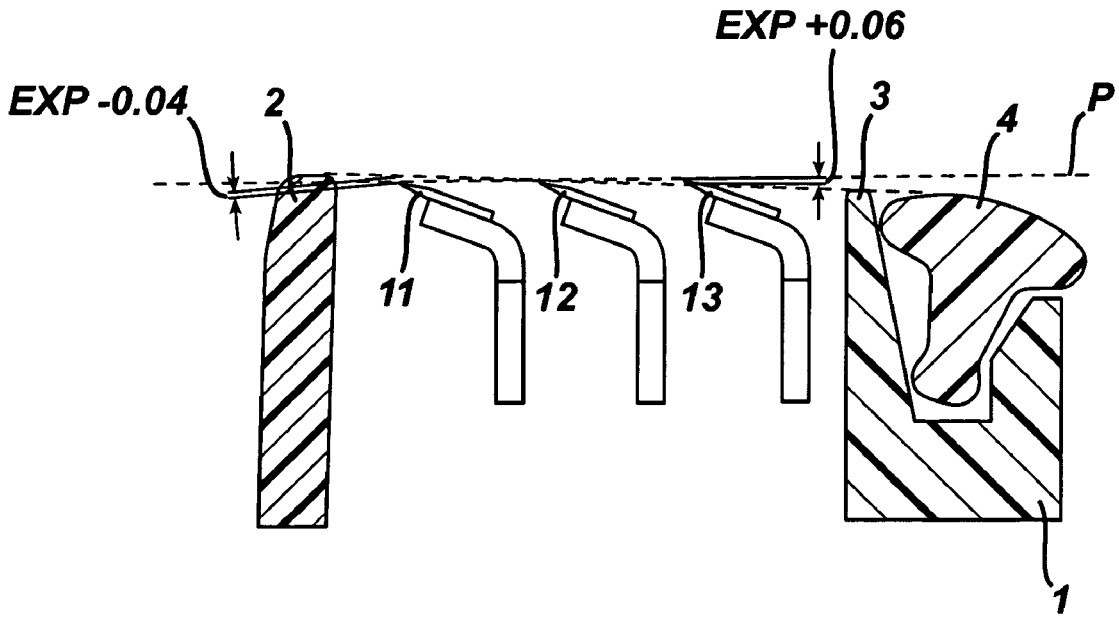
FIG. 1 is a cross-sectional view of a blade unit.

In various implementations, different blades of the razor have different tip radii and thus different relative sharpness. The blade sharpness may be quantified by measuring cutter force, which correlates with sharpness. Cutter force is measured by the wool felt cutter test, which measures the cutter forces of the blade by measuring the force required by each blade to cut through wool felt. The cutter force of each blade is determined by measuring the force required by each blade to cut through wool felt. Each blade is run through the wool felt cutter 5 times and the force of each cut is measured on a recorder. The lowest of 5 cuts is defined as the cutter force.

The combination and positioning of sharper and duller blades can be selected so as to provide a razor with desired performance characteristics. Generally, the sharper the blade the lower the engagement time in the hair. Increased engagement time, achieved with relatively duller blades, will result in hairs being pulled from the follicle during cutting. However, the manner in which a particular blade functions will depend on its exposure as well as on its sharpness. The blades may also have different coefficients of friction, which will affect how the blade interacts with the shaver's skin and hair. For example, a blade having a higher coefficient of friction will tend to pull hair from the follicle while cutting it, as will be discussed in further detail below. These two variables (tip radius and coefficient of friction) will be discussed in turn below.

Tip Radius

Referring to FIG. 1, a blade unit of a razor cartridge includes a frame 1 defining a guard 2, and a cap 3. As shown the cap comprises a lubricating strip 4 mounted on the frame. The strip may be of a form well known in the art. Carried by the frame are primary, secondary and tertiary blades 11,12,13 having parallel sharpened edges. The blades may be supported firmly by the frame to remain substantially fixed in the positions in which they are depicted (subject to any resilient deformation which the blades undergo under the forces applied against the blades during shaving). Alternatively the blades may be supported for limited movement against spring restoring forces, e.g. in a downward direction as viewed in the drawings.

In the blade unit of FIG. 1, the edges of all three blades lie in a common plane P. The blade exposure is defined to be the perpendicular distance or height of the blade edge measured with respect to a plane tangential to the skin contacting surfaces of the blade unit elements next in front of and next behind the edge. Therefore, for the three-bladed blade unit shown in FIG. 1, the exposure of the first or primary blade is measured with reference to a plane tangential to the guard and the edge of the second blade, and the exposure of the third or tertiary blade is measured with reference to a plane tangential to the edge of the second blade and the cap. Blade exposure may be neutral, if the tip is in the plane; positive, if the tip extends beyond the plane towards the user; or negative, if the tip is recessed behind the plane, away from the user. Generally, the greater the exposure, the closer the blade will tend to shave, but also the more likelihood that the blade will nick or cut the user. Blades with negative exposures will nonetheless cut hair, due to the deformable nature of skin and thus the tendency of the skin bulge to flow into the recessed area and towards the blade.

In the embodiment shown in FIG. 1, the primary blade 11 has a negative exposure (e.g., −0.04 mm), the exposure of the secondary blade 12 is zero, and the exposure of the tertiary blade 13 is positive (e.g., +0.06 mm), with the edges of all three blades lying in plane P. Thus, there is a progressive increase in blade exposure from the leading blade 11 to the trailing blade 13. Razor cartridges having blades with progressively different exposures are described in U.S. Pat. No. 6,212,777, the complete disclosure of which is hereby incorporated by reference herein.

In one embodiment, the primary blade 11, which has a negative exposure, has a smaller tip radius and therefore is sharper and exhibits a lower cutter force than the secondary blade 12. Preferably, the tertiary blade 13 has a smaller tip radius than the secondary blade, e.g., a tip radius approximately equal to the tip radius of the primary blade or in between the tip radii of the primary and secondary blades. In this case, the primary blade will tend to cut hair, and the tertiary blade will cut the hair that is pulled by the secondary blade. The inclusion of the relatively dull secondary blade tends to reduce the incidence of nicks and cuts, without compromising shaving closeness. The primary blade may be quite sharp without significant risk of nicks and cuts due to its negative exposure.

In some alternative embodiments, the tertiary blade, which has the highest level of exposure, may have a tip radius that is equal to or greater than that of the secondary blade. This option is advantageous for users who have a high propensity for nicking and cutting.

In some instances, the primary blade has a tip radius of less than 300 angstroms, e.g., about 235 to about 295, resulting in a cutter force of less than about 1.15 lbs, preferably less than about 1.05 lbs. This is considered herein to be a relatively sharp blade. If it is desired that the primary blade be sharper than the secondary blade, the tip radius of the primary blade may be selected to provide a cutter force of at least about 0.1 lbs lower, preferably at least about 0.4 lbs lower, than the cutter force of the secondary blade. In general, the tip radius of the secondary blade may be from about 600 to about 1000 angstroms, if a quite dull secondary blade is desired, or from about 350 to about 450 angstroms, if it is desired that the secondary blade be only slightly less sharp than the primary blade. A tip radius of 600 to 1000 angstroms will generally produce a cutter force of about 1.75 to 2.0 lbs, whereas a tip radius of 350 to 450 angstroms will generally produce a cutter force of about 1.3 to 1.6 lbs. The tertiary blade may have a tip radius of about 235 to about 1000 angstroms, depending on whether it is desired that the tertiary blade be relatively sharper or duller than the other blades.

In other embodiments, it may be desirable to have the primary blade be less sharp than the secondary blade. If the primary blade is less sharp than the secondary blade, the primary blade will tend to pull the hairs further out of the follicle during cutting than a normally sharp blade, so that after cutting the hairs will be further out of the follicle than with a normally sharp blade and thus be cut further down the shaft by the second blade so that when they retract into the follicles their ends will be beneath the skin surface. For example, the primary blade may have a tip radius of from about 350 to about 450 angstroms, while the secondary blade has a tip radius of from about 235 to about 295 angstroms. In these implementations, the tertiary blade may have the same sharpness as the secondary blade, may be sharper or duller than the secondary blade, or may even be as dull as or duller than the primary blade. Having a relatively dull tertiary blade will tend to give a very safe shave, with little danger of nicking or cutting, while having a relatively sharp tertiary blade will provide a very close shave.

The tip radius R may be varied by controlling the properties of the coatings applied to the blade tip, for example by adjusting the sputtering conditions. The bias on the blades, prior to and/or during sputter deposition, can be varied to effect the etch rate. Generally, blades processed with high bias voltage (e.g., greater than −1000 vdc) yield smaller tip radii and thus lower cutter forces than blades processed at low bias voltages (e.g., less than −200 Volts Direct Current (vdc)). The ion to atom ratio can also be varied to control the deposition and etch rates. Alternatively, the blades may be ion etched post-sputtering to reduce the tip radius. In this case the sputtering conditions would be controlled to provide a high tip radius and then the tip radius would be reduced to a desired level using ion etching. Suitable processes are described in U.S. Pat. No. 4,933,058, the disclosure of which is incorporated herein by reference. Another alternative would be to vary the tip radius by controlling the sharpening process so as to obtain a desired tip radius during sharpening.

If desired, the razor can include four, five or more blades. The blades may have various combinations of sharpness. For example, in a razor having four blades, two blades with higher cutter forces may be positioned to alternate with two blades having lower cutter forces. The blades with the higher cutter forces may be the primary and tertiary blades, or in an alternate embodiment may be the secondary and quaternary blades. In these and other embodiments, the blade(s) having a higher cutter force may in some cases have a tip radius of from about 350 to about 450 angstroms, while the blade(s) having a lower cutter force has a tip radius of from about 235 to about 295 angstroms. In determining the desired degree of sharpness of the various blades, the principles discussed above apply, i.e., a duller blade generally will provide greater safety and will apply tension to hair and pull it from the follicle allowing it to be cut more closely by subsequent blades, while a sharper blade will cut hair more closely and with less cutter force. Generally, providing duller blades in more exposed positions will reduce the incidence of nicks and cuts, while providing sharper blades in these positions will provide a closer, more comfortable shave. It has also been noted by the inventors that for certain women's razors it is generally desirable to provide a sharp blade in the primary position, regardless of the number of blades used. A desired combination of blades of differing sharpness can be determined based on the desired performance attributes of the razor.

Coefficient of Friction

Referring again to FIG. 1, primary blade 11 may have a higher coefficient of friction (measured as a higher cutter force) than secondary blade 11. When the razor is in use, the primary blade 11 will contact the hair before the secondary blade 12. As blade 11 passes the user's skin, it engages a hair, pulling it and thereby extending the hair outside of the hair follicle, and cutting the hair to a first length. As the secondary blade 12 passes the user's skin it cuts the hair again, to a shorter length. Subsequent to cutting, the hair settles back into the hair follicle below the surface of the skin. The tertiary blade can have any desired cutter force, typically within a 0.8 to 1.5 pound range.

Many other combinations of blades having different coefficients of friction may be used, e.g., a blade having a relatively low coefficient of friction in the primary position, a blade having a relatively higher coefficient of friction in the secondary position, and a blade having a relatively low coefficient of friction in the tertiary position.

In some instances, the blade(s) having relatively low coefficients of friction have cutter forces (as measured using a wool felt cutter) at least about 0.1 lbs greater than the cutter forces of the blade(s) having relatively high coefficients of friction. In general, the cutter force of the low coefficient of friction blade(s) is between about 0.1 and 1.0 lbs. (e.g., at least about 0.2, 0.3, 0.4, or 0.5 lbs. and at most about 1.0, 0.9, 0.8, 0.7 or 0.6 lbs.) less than that of the blades having relatively higher coefficients of friction.

Providing a blade having higher cutter forces can be accomplished in a variety of ways. In some instances, it is desirable to provide a first blade having a modified polymer coating. For example, the blade may include a Teflon coating that is modified, for example using plasma etching, to incrementally increase its surface friction. Exposure of the coated blade to plasma under suitable conditions can cause both chemical and physical changes to occur on the polymer coating. The changes can affect a variety of properties of the coating, including but not limited to roughness, wettability, cross-linking, and molecular weight, each of which can affect the cutter force of the blade. Suitable methods of modifying the polymer coating are described in U.S. Ser. No. 11/392,127 filed Mar. 29, 2006 and entitled Razor Blades and Razors, the complete disclosure of which is hereby incorporated herein by reference.

In some instances, a blade can be used that is substantially free of polymer coating. However, a blade without any polymer coating can result in an undesirable decrease in comfort. For example, it may pull the hair too aggressively.

Combining Tip Radius, Frictional Force and Blade Exposure

Many different combinations of these three parameters are contemplated with different combinations yielding different razor performance characteristics. For example, in some cases, it is desirable to have a relatively sharp (small tip radius) blade that has a relatively high coefficient of friction (high cutter force due to the surface characteristics of the blade rather than the tip radius). Such a blade will tend to cut hair comfortably, while also providing a hysteresis effect (pulling the hair from the follicle so that the next blade can cut it more closely before it retracts into the follicle). Thus, it may be desirable to have the primary blade have a small tip radius and relatively high coefficient of friction. The secondary blade may have a larger tip radius, due to its relatively higher blade exposure, and a lower coefficient of friction, since it is not necessary that this blade pull hair. The characteristics of the tertiary blade may be selected to suit the needs of a particular user group, e.g., avoidance of nicking and cutting (large tip radius) or closeness (small tip radius; high coefficient of friction if a fourth blade is used).

OTHER EMBODIMENTS

A number of embodiments of the invention have been described. Nevertheless, it will be understood that various modifications may be made without departing from the spirit and scope of the invention.

Accordingly, other embodiments are within the scope of the following claims.

What is claimed is:

1. A razor comprising:

a safety razor blade unit comprising a guard, a cap, and first, second and third blades with parallel sharpened edges located between the guard and cap with the first blade closest to the guard, the third blade furthest from the guard, and the second blade disposed between the first and third blades, the blades having first, second and third tip radii, respectively, at least two of the three blades having different tip radii, and wherein the first blade has a higher coefficient of friction than the second blade and wherein there is a progressive exposure difference from the first to third blade.

2. The razor of claim 1 wherein the first blade has a smaller tip radius than the second blade.

3. The razor of claim 2 wherein the third blade has a smaller tip radius than the second blade.

4. The razor of claim 1 wherein the first blade has a higher coefficient of friction than the third blade.

5. The razor of claim 1 wherein at least two of the blades include polymer coatings having different relative thicknesses.

6. The razor of claim 1 comprising four blades with parallel sharpened edges.

7. The razor of claim 6 comprising five blades with parallel sharpened edges.

* * * * *